US009328466B2

(12) United States Patent
Sweeney et al.

(10) Patent No.: US 9,328,466 B2
(45) Date of Patent: May 3, 2016

(54) INTEGRATED CARRIAGE FOGGING SYSTEM FOR CONCRETE PAVERS

(71) Applicant: Terex USA, LLC, Westport, CT (US)

(72) Inventors: John C Sweeney, Sioux Falls, SD (US); Larry Eben, Plant City, FL (US)

(73) Assignee: Terex USA, LLC, Westport, CT (US)

( * ) Notice: Subject to any disclaimer, the term of this patent is extended or adjusted under 35 U.S.C. 154(b) by 0 days.

(21) Appl. No.: 14/486,347

(22) Filed: Sep. 15, 2014

(65) Prior Publication Data

US 2015/0003913 A1 Jan. 1, 2015

Related U.S. Application Data

(63) Continuation of application No. 13/351,015, filed on Jan. 16, 2012, now Pat. No. 8,834,064.

(51) Int. Cl.

| | |
|---|---|
| ***E01C 23/03*** | (2006.01) |
| ***B05B 1/20*** | (2006.01) |
| ***B05B 1/30*** | (2006.01) |
| ***B05B 13/00*** | (2006.01) |
| ***B05B 15/06*** | (2006.01) |
| ***B05B 9/01*** | (2006.01) |
| ***E01C 21/00*** | (2006.01) |

(52) U.S. Cl.

CPC . *E01C 23/03* (2013.01); *B05B 1/20* (2013.01); *B05B 1/3026* (2013.01); *B05B 9/01* (2013.01); *B05B 13/005* (2013.01); *B05B 15/061* (2013.01); *E01C 21/00* (2013.01)

(58) Field of Classification Search

USPC ..... 239/159, 163, 172, 754; 404/106, 108, 404/111; 248/49, 58, 65, 74.1

IPC ..... B05B 9/007; E01C 19/176,21/00

See application file for complete search history.

(56) References Cited

U.S. PATENT DOCUMENTS

| | | | | |
|---|---|---|---|---|
| 1,865,109 | A | 6/1932 | Johnson | |
| 3,199,423 | A | 8/1965 | Dickey | |
| 4,735,365 | A | 4/1988 | Smeller et al. | |
| 5,324,136 | A | 6/1994 | Reymonet et al. | |
| 5,957,621 | A | 9/1999 | Clark et al. | |
| 6,497,531 | B2 | 12/2002 | Sipherd et al. | |
| 6,805,516 | B2 | 10/2004 | Barnat et al. | |
| 7,438,764 | B1 | 10/2008 | Hill | |
| 7,488,138 | B2 | 2/2009 | Buschmann | |
| 7,798,744 | B2 | 9/2010 | Larson et al. | |
| 8,834,064 | B2 * | 9/2014 | Sweeney et al. | 404/111 |
| 2015/0176229 | A1 * | 6/2015 | Thieme et al. | E01C 23/08 |

* cited by examiner

*Primary Examiner* — Gary Hartmann

(74) *Attorney, Agent, or Firm* — Simmons Perrine Moyer Bergman PLC

(57) ABSTRACT

A concrete paver system with a reconfigurable hydration system which utilizes a plurality of individually flow controllable spray nozzles, which are clamped on support structures, which also support objects being dragged across a top surface of concrete which is being finished. The plurality of flow controllable spray nozzles being configured to be moved about said hydration system so as to change a pattern of water vapor application, all without the use of tools.

20 Claims, 4 Drawing Sheets

110
21
22
23
24
130
19
25
6
500
502
120
506
10
700
7

INTEGRATED CARRIAGE FOGGING SYSTEM FOR CONCRETE PAVERS

CROSS REFERENCE TO RELATED APPLICATIONS

This application is a continuation of a non-provisional application filed on Jan. 16, 2012, and having Ser. No. 13/351,015, entitled "INTEGRATED CARRIAGE FOGGING SYSTEM FOR CONCRETE PAVERS".

BACKGROUND OF THE INVENTION

This invention relates to concrete paving equipment and more particularly to fogging systems used to apply water vapor to a new concrete surface. Concrete begins to cure immediately when it is mixed. High ambient temperature, low humidity, direct sunlight and wind will tend to accelerate drying of the concrete surface. In some situations, this can make it difficult to finish the concrete surface with the desired texture, seal and cause surface cracking.

Fogging systems having evolved from simple bug sprayers, pressure washers and garden hoses to the sophisticated integrated finishing carriage fogging systems of today, which provide for fogging of the surface next to the carriage and fogging the drag pans and other drags.

While these integrated carriage fogging systems have enjoyed some commercial success in the industry, they have drawbacks.

The systems with galvanized water distribution and sprayer mounting bars mounted to the finishing carriage have experienced spraying disruptions which can affect multiple sprayers, or in some failure modes all of the sprayers, thereby causing a large scale problem which required immediate repairs. Also, in some situations the unevenness of spraying causes problems. Lastly, such systems did not accommodate readily adding or subtracting a sprayer from collection of sprayers to change the spray pattern.

In systems with above the H-frame sprayer support weldments, it was difficult to add or remove new sprayers.

Consequently, there is a need for improvement in integrated finishing carriage fogging systems which reduces the frequency of need for urgent repairs and for duration of downtime associated with repairs.

SUMMARY OF THE INVENTION

More specifically, an object of the invention is to provide an efficient system for hydrating concrete pavement surfaces.

It is a feature of the present invention to include a separate sprayer head mounting bar and non-galvanized water distribution line for an on-the-finishing-carriage fogging system.

It is another feature of the present invention to provide an individual flow rate controlled valve for each on-the-finishing-carriage spray head.

It is an advantage of the present invention to provide for fewer clogged sprayer heads on the finishing carriage and fewer occasions where a broken spray head would require immediate repair or shut down of the fogger system.

It is another object of the present invention to provide for increased ability to economically reconfigure a fogging system.

It is another feature of the present invention to include a clamp-on sprayer head mount, which is configured for direct attachment to both the H-frame structure supporting the drag pans and to the on-the-finishing-carriage sprayer head mounting bar.

It is an advantage of the present invention to increase the ability to relocate a spray head without use of tools.

It is another feature of the present invention to provide a clamp-on quick release water distribution junction for allowing the addition of and relocation of spray heads.

It is an advantage of the present invention to allow for attachment of a water distribution section without use of tools and without the need for tie-wrapping.

The present invention includes the above-described features and achieves the aforementioned objects and advantages.

Accordingly, the present invention comprises:

A concrete paver system comprising:

a concrete paver comprising a carriage;

a hydration system configured to spray a fluid toward a surface below portions of the concrete paver;

the hydration system being coupled to and transported along with said carriage while said carriage moves back and forth across said surface; the hydration system comprising:

a plurality of spray heads each coupled to a support structure coupled to and supported by said carriage, wherein said support structure does not act as a pipe, through which said fluid flows;

each of said plurality of spray heads further comprising; a spray nozzle; and a controllable flow rate control valve coupled to said spray nozzle; and a connection to a fluid source.

The present invention also comprises:

A concrete paver system comprising:

a concrete paver comprising a finishing carriage;

a wetting system configured to spray a fluid on a concrete surface below the concrete paver;

the wetting system being coupled to and moved by said finishing carriage, while said finishing carriage moves back and forth across a lateral extent of said surface of concrete; the wetting system comprising:

a plurality of spray heads each coupled to a linear support structure, coupled to and fully supported by said finishing carriage, wherein said linear support structure does not act as a member, through which fluid used for wetting by the wetting system flows;

a plurality of spray heads coupled directly to a pan frame assembly;

each of said plurality of spray heads further comprising: a spray nozzle.

BRIEF DESCRIPTION OF THE DRAWINGS

In the following description of the drawings, like reference numerals are employed to indicate like parts, in the various views.

DETAILED DESCRIPTION OF THE DRAWINGS

Figure 1:
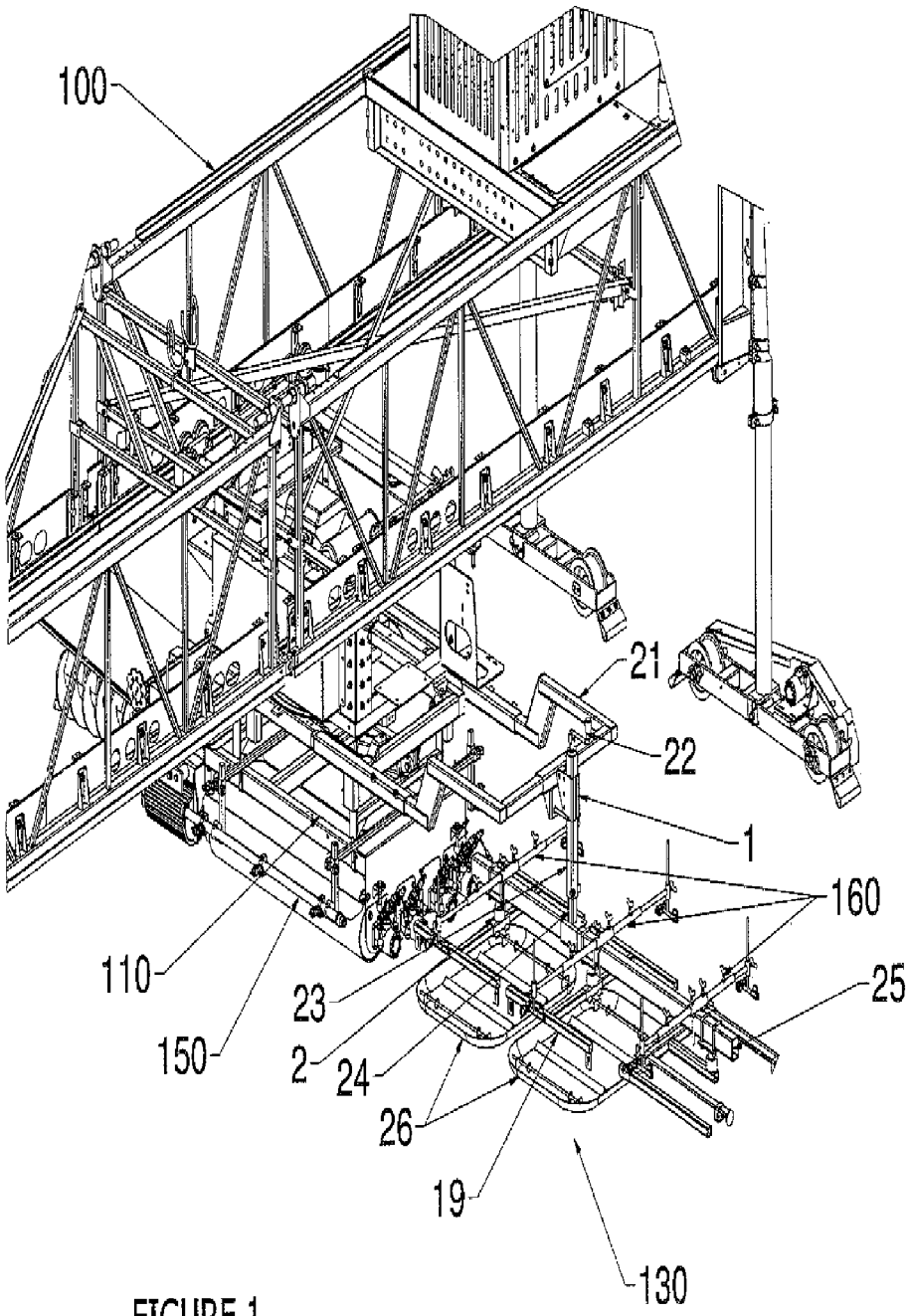
FIGURE 1 PRIOR ART
FIG. 1 is a perspective view of a concrete paving system of the prior art.

Now referring to the drawings, where like numerals refer to like matter throughout, and more specifically to FIG. 1, there is shown a perspective view of a concrete paving system of the prior art which includes a bridge paver, generally designated 100 with a finishing carriage 110. Coupled to finishing carriage 110 is drag finishing system, generally designated 130 with a hydration system which includes a water supply line and a finishing carriage fogger bar 150, which acts like a water distribution manifold and a sprayer support bar. Coupled to drag finishing system 130 are spray head support bars 160. Drag finishing system 130 further includes:

A drag pan to finishing carriage mount arm 21 for coupling with a finishing carriage 110 of a concrete paver 100.

Drag pan to finishing carriage mount arm 21 which is coupled on one end to the carriage 110 and on the other end to an arm to jack mount 1 which connects to a second drag pan to finishing carriage mount arm 21. Arm to jack mount 1 receives therein drag mount vertical outer tube 23 which is the outer portion of a jack similar to a jack to support the tongue of a trailer when it is detached from a motor vehicle. Drag mount vertical outer tube 23 is shown having a vertical inner jack tube 24 extending down therefrom. When vertical high adjusting crank 22 is turned, the vertical inner jack tube 24 is either extended from or retracted into drag mount vertical outer tube 23. This is done to adjust the contact between the finishing drag pan 26 and the concrete surface to be finished. Coupled to vertical inner jack tube 24 is drag mount horizontal mounting tube 25 which provides support to the pan H-frame assembly 19 which are mounted to the drag mount horizontal mounting tube 25 via H-frame to horizontal tube mount 2. Finishing drag pan 26 may be hung by chains, cables or other structures, from the pan H-frame assembly 19. The pan assembly is free of any supporting attachments other than the chains, cables, etc., from which the finishing drag pans 26 are hung.

Figures 2, 3, 4, 5:
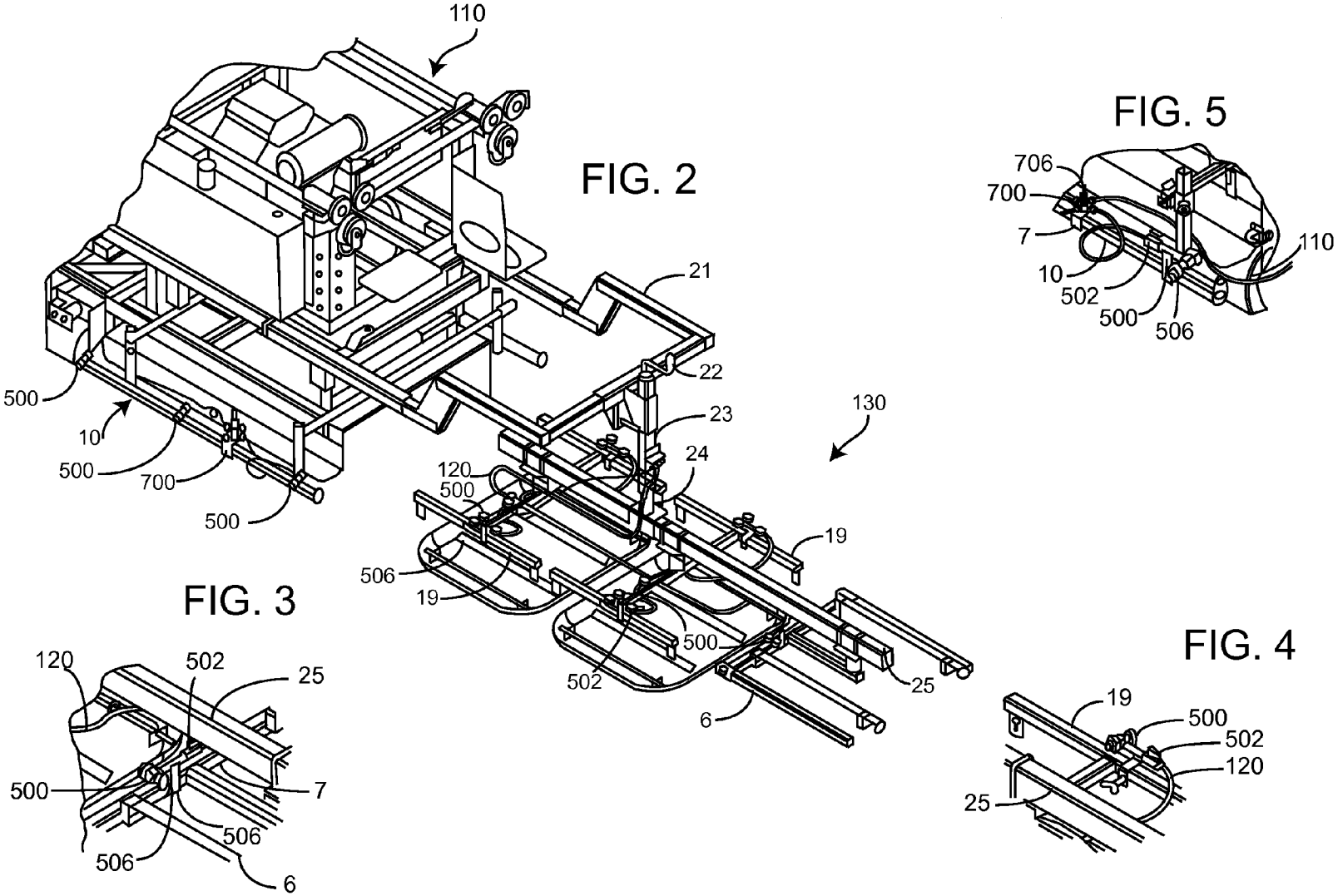
FIG. 2 is a perspective view of a combined finishing carriage hydration and drag finishing and hydration system of the present invention.
FIG. 3 is a detail of section B of FIG. 2.
FIG. 4 is a detail of section C of FIG. 2.
FIG. 5 is a detail of section D of FIG. 2.

Now referring to FIG. 2, there is shown a detailed view of a finishing carriage fogging system and drag finishing system of the present invention. The system includes a water supply line 120 or other suitable water supply systems water or other liquids from a water tank and pump or pressurization mechanism which also is well known in the prior art. This figure may be logically divided into two portions, that which is on the finishing carriage 110 and that which is on the drag finishing system 130 dragged behind the finishing carriage 110.

Finishing carriage spray support 10 is coupled to some portion of the finishing carriage 110.

Finishing carriage spray support 10 is shown as a rectangular support bar which is preferably similar or identical in cross section to the pan H-frame assembly 19 so that a plurality of spray head assemblies 500 (FIG. 6) can be attached directly thereto. Finishing carriage spray support 10 is merely a support rod or bar which provides only physical support for portions of the hydration system. The various spray head assemblies 500 may be coupled to a water supply line in a manner similar to the way the spray nozzles of the drag finishing system 130 of the prior art were coupled to the water source. For example, this could be done by a water distribution system coupled to the water supply line 120 extending out to the finishing carriage 110. Then these water supply lines may be branched out to smaller lines to the spray nozzles through various connectors, including but not limited to, a 3 to 1 cross connector 700 (FIG. 7) in the shape of a cross. Such a cross connector may have water lines press fit thereon so as to allow for quick connecting or disconnecting of water supply lines. In the present invention, reconfiguration of the number and location of spray head assemblies 500 can be made quicker and easier by the use of a 3 to 1 cross connector 700 which could be supported by the finishing carriage spray support 10 via a fogger cross connector attachment 7, which is a clamped structure having a wing fastener 4 (FIG. 4) such as a wing bolt or a wing nut in an alternate configuration. Still other quick physical support connections and connectors could be utilized instead of a wing fastener 4. However, it is preferable to avoid the use of tie wraps as was done with prior art systems. In FIG. 2, the spray head assembly 500 is shown as having an individually flow rate controllable valve 502 and a spray nozzle 506; more details are given in FIG. 6.

In FIG. 2 the drag pan hydration system differs from the hydration system of FIG. 1 in several ways, including the fact that the spray head assembly 500 is directly clamped to the pan H-frame assembly 19 and the burlap head attachment 6. The spray head support bars 160 of FIG. 1 are not necessary and are made obsolete by the present invention. The water supply to the various drag pan mounted spray head assembly 500 is done in a manner similar to the finishing carriage mounted spray head assembly 500 and the prior art for the drag pan mounted nozzles.

Now referring to FIG. 3, there is shown a more detailed view of the section B of FIG. 2.

Now referring to FIG. 4, there is shown a detail view of section C of FIG. 2.

Now referring to FIG. 5, there is shown a detail view of portion D of FIG. 2.

Figure 6:
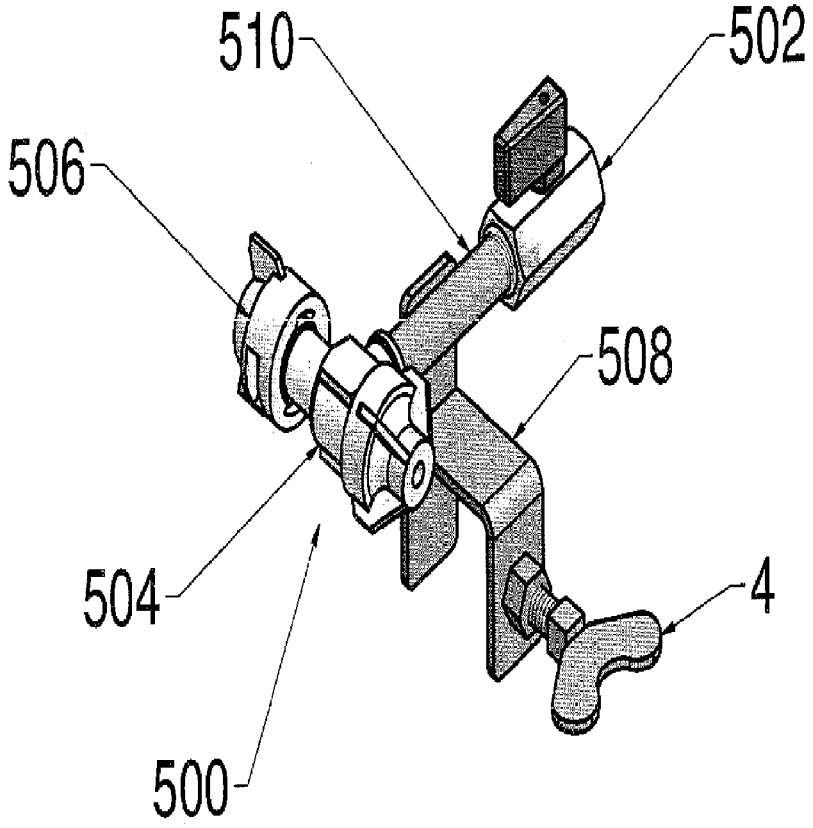
FIG. 6 is a perspective view of a spray head assembly of the present invention.

Now referring to FIG. 6, there is shown a spray head mount frame 508. Spray head assembly 500 could be viewed as including spray head mount frame 508 which is coupled to the pan H-frame assembly 19 or other structure with the wing fastener 4. Spray head mount frame 508 is coupled to water pipe 510 which carries water from the individually flow rate controllable valve 502 and delivers it to the spray nozzle mount 504 and spray nozzle 506. The present invention can utilize many identical spray head assemblies 500 which are attached to prior art structures such as pan H-frame assembly 19 and burlap drag mounting frame weldment 3. As well as finishing carriage spray support 10.

Figure 7:
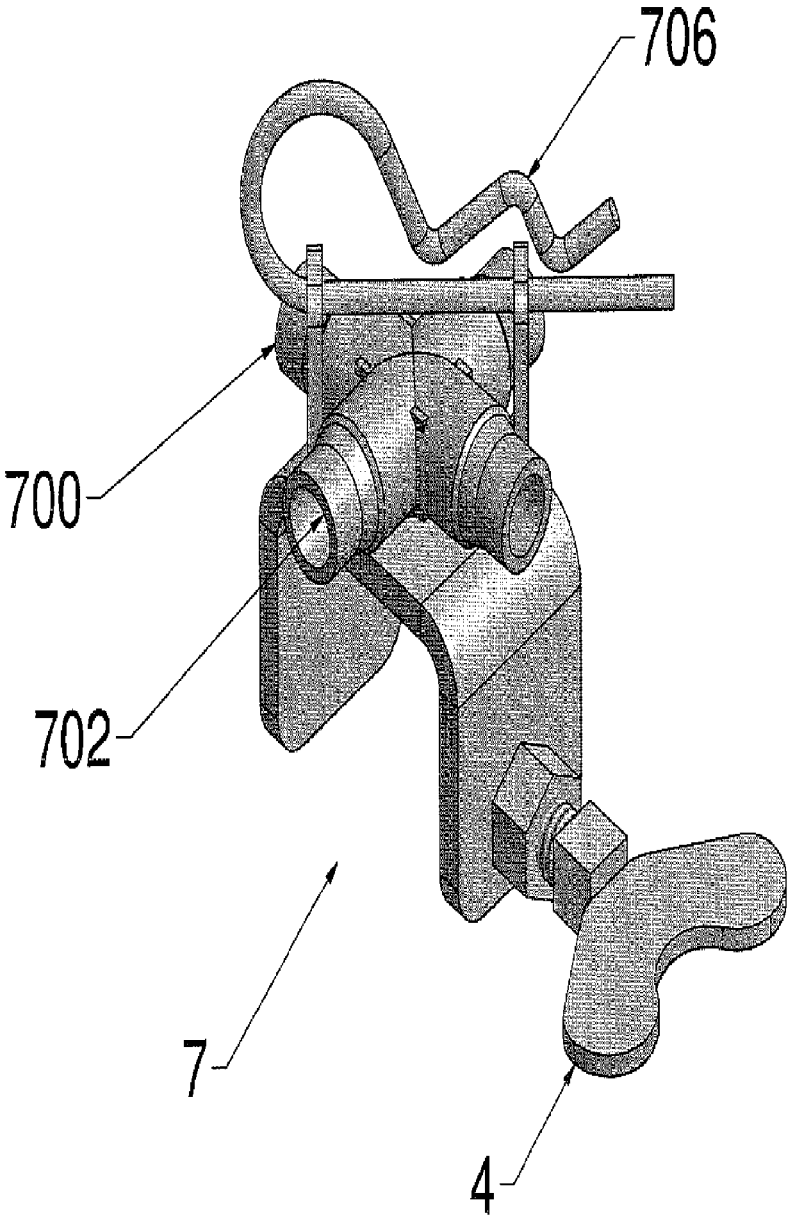
FIG. 7 is a perspective view of a fogger cross connector attachment clamp together with a connector and retaining pin of the present invention.

Now referring to FIG. 7, there is shown a fogger cross connector attachment 7 with a wing fastener 4 and a 3 to 1 connector, generally designated 700 having a distal terminal end 702 which is configured for mating to make a connection with a water line. Also shown, is a retainer pin 706 used to allow for quick removal of the connector 700. It should be noted that the connector 700 need not be a 3 to 1 connector. A 2 to 1 connector with three ends could be utilized or a star shaped connector with more than 4 ends could be utilized, still other connectors are suitable as well.

It is believed that when these teachings are combined with the known prior art by a person skilled in the art, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

We claim:

1. A concrete paver system comprising:

a concrete paver comprising a carriage;

a hydration system configured to spray a fluid toward a surface below portions of the concrete paver;

the hydration system being coupled to and transported along with said carriage while said carriage moves back and forth across said surface; the hydration system comprising:

a plurality of spray heads each coupled to a support structure coupled to and supported by said carriage, wherein nothing supporting said plurality of spray heads act as a pipe, through which said fluid flows;

each of said plurality of spray heads further comprising;

a spray nozzle; and a controllable flow rate control valve coupled to said spray nozzle; and a connection to a fluid source.

2. The system of claim 1 wherein said support structure is a frame.

3. The system of claim 2 wherein said frame is a pan frame.

4. The system of claim 3 where said pan frame is a pan H-frame assembly.

5. The system of claim 1 wherein said fluid is water.

6. The system of claim 5 wherein said surface is a concrete surface.

7. The system of claim 6 wherein each of said plurality of spray heads is detachably coupled to said support structure.

8. The system of claim 7 wherein said controllable flow rate control valve is individually controllable.

9. The system of claim 8 wherein each of said plurality of spray heads is clamped to said support structure.

10. The system of claim 9 wherein said support structure is a pan H-frame assembly which supports a drag pan which is hung by chains.

11. A concrete paver system comprising:

a concrete paver comprising a finishing carriage;

a wetting system configured to spray a fluid on a concrete surface below the concrete paver;

the wetting system being coupled to and moved by said finishing carriage, while said finishing carriage moves back and forth across a lateral extent of said surface of concrete; the wetting system comprising:

a plurality of spray heads each coupled to a linear support structure, coupled to and fully supported by said finishing carriage, wherein said plurality of sprays heads are fully supported without a member, through which fluid used for wetting by the wetting system flows;

a plurality of spray heads coupled directly to a pan frame assembly;

each of said plurality of spray heads further comprising: a spray nozzle.

12. The system of claim 11 wherein said pan frame assembly supports a drag pan, which is hung.

13. The system of claim 12 wherein each of said plurality of spray heads further comprises an valve.

14. The system of claim 13 wherein said valve is a flow rate control valve.

15. The system of claim 14 wherein each of said plurality of spray heads further comprises a clamp coupled to said spray nozzle.

16. The system of claim 15 wherein said fluid is water.

17. The system of claim 16 wherein said linear support is a single linear support.

18. The system of claim 17 wherein said drag pan is hung by chains.

19. The system of claim 18 said flow rate control valve is an individually controllable flow rate control valve.

20. A concrete paver system comprising:

a concrete paver comprising a finishing carriage;

a hydration system configured to spray a fluid toward a concrete surface below portions of the concrete paver;

the hydration system being coupled to and transported along with said finishing carriage while said finishing carriage moves back and forth across said concrete surface; the hydration system comprising:

a plurality of spray heads each being detachably coupled to a single linear support structure coupled to and supported by said finishing carriage, wherein no support of said plurality of spray heads comes from a pipe, through which said fluid flows;

each of said plurality of spray heads further comprising:

a spray nozzle; and an individually controllable flow rate control valve coupled to said spray nozzle; and a connection to a fluid source.

* * * * *